United States Patent [19]

Issakainen

[11] Patent Number: 4,632,618

[45] Date of Patent: Dec. 30, 1986

[54] FEED STORAGE FOR DRILL RODS FOR A LONG-HOLE DRILLING APPARATUS

[75] Inventor: Onni Issakainen, Tampere, Finland

[73] Assignee: Oy Tampella AB, Tampere, Finland

[21] Appl. No.: 837,642

[22] Filed: Mar. 5, 1986

Related U.S. Application Data

[63] Continuation of Ser. No. 488,737, Apr. 26, 1983, abandoned.

[30] Foreign Application Priority Data

May 26, 1982 [FI] Finland ..... 821875

[51] Int. Cl.[4] ..... E21B 19/14

[52] U.S. Cl. ..... 414/22; 175/52; 198/737; 198/776; 221/75; 414/745

[58] Field of Search ..... 414/22, 745; 175/52, 175/85; 198/737, 740, 776; 221/75

[56] References Cited

U.S. PATENT DOCUMENTS

| | | | |
|---|---|---|---|
| Re. 29,020 | 11/1976 | Moody et al. | 414/22 X |
| 1,919,199 | 7/1933 | Camerota | 198/776 |
| 3,506,075 | 4/1970 | Attebo | 414/22 X |
| 3,552,506 | 1/1971 | Mayer | 414/22 X |
| 3,613,905 | 10/1971 | Woolslayer et al. | 414/22 |
| 3,730,333 | 5/1973 | Wakabayashi et al. | 198/776 |
| 3,965,994 | 6/1976 | Hilding | 175/52 |

FOREIGN PATENT DOCUMENTS

| | | | |
|---|---|---|---|
| 57-184006 | 11/1982 | Japan | 198/776 |

*Primary Examiner*—Leslie J. Paperner
*Attorney, Agent, or Firm*—Ladas & Parry

[57] ABSTRACT

A feed storage for drill rods for a long-hole drilling apparatus, said feed storage comprising a magazine provided with fixed guides (11) for storing drill rods (13) in parallel with each other, a delivery opening (14) defined by the guides for transferring drill rods one at a time into and out of the guides, and a feed device provided with gripping means (27) extending between the drill rods positioned in the guides for feeding the drill rods towards and away from the delivery opening in the guides, and a transfer device (9) comprising at least one transfer arm (29) provided with gripping jaws (31) and pivotably mounted on a pivot shaft (30) which is fixed with respect to the magazine so that the gripping jaws are displaced transversally with respect to the axial direction of the drill rods between the delivery opening of the guides and the drilling axis (A) of a drilling machine. The guides of the magazine guide the drill rods with their axes in the same plane. The feed device comprises two feed plates carrying out movements in opposite directions. The transfer arm is pivoted so that the gripping jaws are displaced along a circular arc between the delivery opening and the drilling axis.

7 Claims, 14 Drawing Figures

FEED STORAGE FOR DRILL RODS FOR A LONG-HOLE DRILLING APPARATUS

This is a continuation of co-pending application Ser. No. 488,737 filed on Apr. 26, 1983, now abondoned.

This invention relates to a feed storage for drill rods for a long-hole drilling apparatus, said feed storage comprising a magazine provided with fixed guides for storing drill rods in parallel with each other, a delivery opening defined by said guides for transferring drill rods one at a time into and out of the guides, and a feed device provided with gripping means extending in between the drill rods in the guides for feeding the drill rods towards and away from said delivery opening, and a transfer device comprising at least one transfer arm provided with gripping jaws and mounted pivotably on a pivot shaft which is fixed with respect to the magazine so that the gripping jaws are displaced transversally with respect to the axial direction of the drill rods between the delivery opening of the guides and the drilling axis of a drilling machine.

A feed storage of this type is mounted adjacent to the feed beam of a drilling machine as a magazine for drill rods. The drill rods are taken one at a time from the magazine and are transferred to the drilling axis in order to connect the drill rod coaxially as an extension of the preceding drill rods as the drilling advances. The drill rods are in a corresponding manner transferred one at a time from the drilling axis back to the magazine after the drilling is completed.

The German Printed Specification No. 2,018,884 discloses a feed storage fastened adjacent to the feed beam of a drilling machine. The transfer device provided in the magazine of the feed storage comprises either a rotary disc or a rectilinearly displaceable slide plate which transfers the drill rods guided by guides towards and away from a delivery opening. The drilling machine is mounted in its feeding device so that the drilling machine is displaced in the transverse direction of the feed beam away from the drilling axis to the delivery opening of the magazine for transferring a drill rod from and into the magazine. The transverse displacement of the drilling machine causes in the feeding device for the drilling machine clearances which, in percussing drilling, result in a rapid wear of the elements of the feeding device. The drill rod lacks guiding means which would permit the use of the magazine when drilling oblique or horizontal holes.

The German Printed Specification No. 1,483,865 describes a feed storage in which the magazine is of the rotary type. The transfer device for the drill rods comprises a transfer arm which is formed by a pressure fluid cylinder and is mounted pivotably with respect to the magazine. The pivoting movements of said transfer arm are controlled by a second pressure fluid cylinder. The transfer of the drill rod from the delivery opening of the magazine to the drilling axis is carried out along two separate paths of movement. The magazine is located remote from the feeding device for the drilling machine, which results in high stresses in the feeding device when the drill rods are massive. The locking of the drill rods in the magazine takes place by means of a spring-loaded cam system.

The German Patent Application No. 2,148,357 describes a feed storage in which the magazine is mounted displaceably with respect to the feed beam so that the magazine is displaced to the drilling axis for transferring a drill rod out of or into the magazine. The moving masses are in this case great. The drill rods are supported by carriages displaceable transversally with respect to the feed beam. The clearances cause wear in percussing drilling. The centre of gravity of the drilling equipment varies considerably due to the movements of the magazine.

The U.S. Pat. No. 3,913,753 describes a feed storage in which the magazine is of the rotary type and is displaced to the drilling axis for transferring of a drill rod. In addition, a separate lock is arranged for each rod whereby the locking mechanism will be expensive.

The Swedish Patent Specification No. 225,859 discloses a feed storage in which a magazine installed adjacent the feed beam includes curved guides for the drill rods. The transfer device includes a transfer arm operated by two pressure fluid cylinders and mounted pivotably with respect to the magazine. The transfer of a drill rod is carried out by means of two wide movements along circular arcs whereby the transfer speed is reduced.

The Finnish Patent Application Nos. 3700/74 and 3701/74 describe a feed storage in which the drill rods are supported by means of curved guides in a fixed magazine. The transfer device for the drill rods includes a transfer arm which is mounted pivotably with respect to the magazine and by means of which the drill rods are transferred into and out of the magazine along two circular arcs. The magazine is located remote from the feeding device for the drilling machine. The drill rods are locked to the guides by means of spring-loaded ratchet wheels only.

The object of this invention is to provide a feed storage for drill rods which eliminates the above mentioned disadvantages. This object is achieved by means of the feed storage according to the invention which is characterized in that the guides of the magazine guide the drill rods to be positioned with their axes in the same plane, and the feed device comprises two feed plates carrying out movements in opposite directions, and the transfer arm is pivoted so that the gripping jaws are displaced along a circular arc between the delivery opening of the guides and the drilling axis.

The invention is based on the idea that, by means of straight guides provided in the magazine, the centre of gravity of the magazine and the transfer device will be positioned as close to the feed beam of the drilling machine as possible, which is of importance especially when using a massive drilling equipment. The position of the centre of gravity is not much changed during the transfer of drill rods due to the fact that the magazine is stationary. The transfer arm carries out a pivoting movement only, and the gripping means are displaced along one circular arc only between the delivery opening in the magazine and the drilling axis, whereby the moving masses are small due to which the stresses resulting from the transfer movement are small. At the same time the velocity of the transfer movement can be relatively high. The transfer arm can be designed so that it prevents the delivery of drill rods from the magazine except when the transfer arm is located in a magazine position, which makes the feed storage safe. The operation of the feed storage is simple because it includes three basic movements only, i.e. the opening and closing of the gripping means of the transfer arm, the pivoting of the transfer arm and the displacement of the feed plates in the magazine.

The invention will be described in more detail in the following with reference to the accompanying drawings, in which FIG. 1 is a schematical side view of a drilling apparatus provided with a feed storage according to the invention, FIG. 2 is an enlarged view from the same direction of one preferred embodiment of the feed storage according to the invention.

Figures 1, 5A, 5B, 5C, 5D, 5E, 5F, 5G:
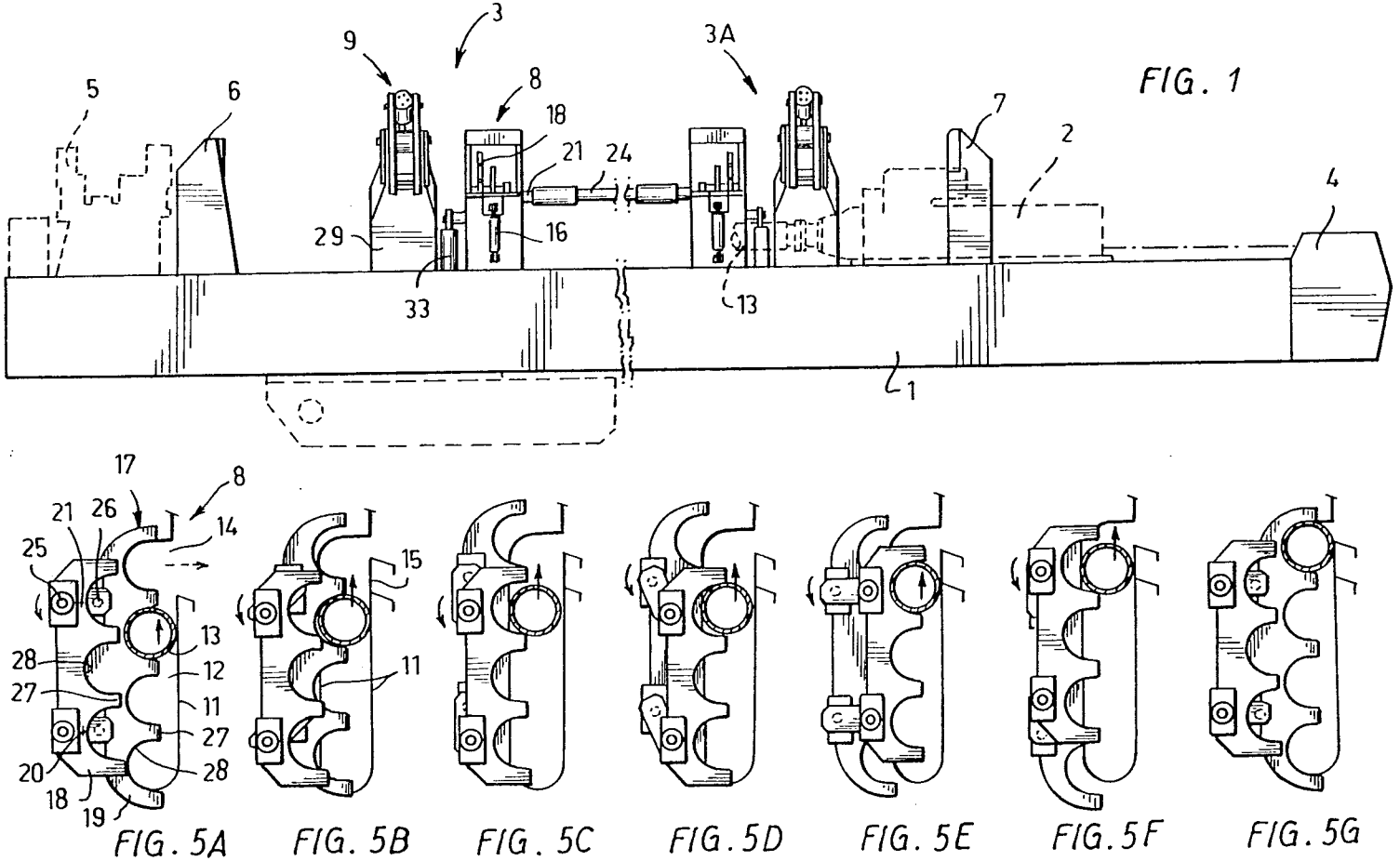
FIGS. 5A to 5G illustrate the feed device of the magazine in the axial direction of the drill rods in different operating positions.
Figure 2:
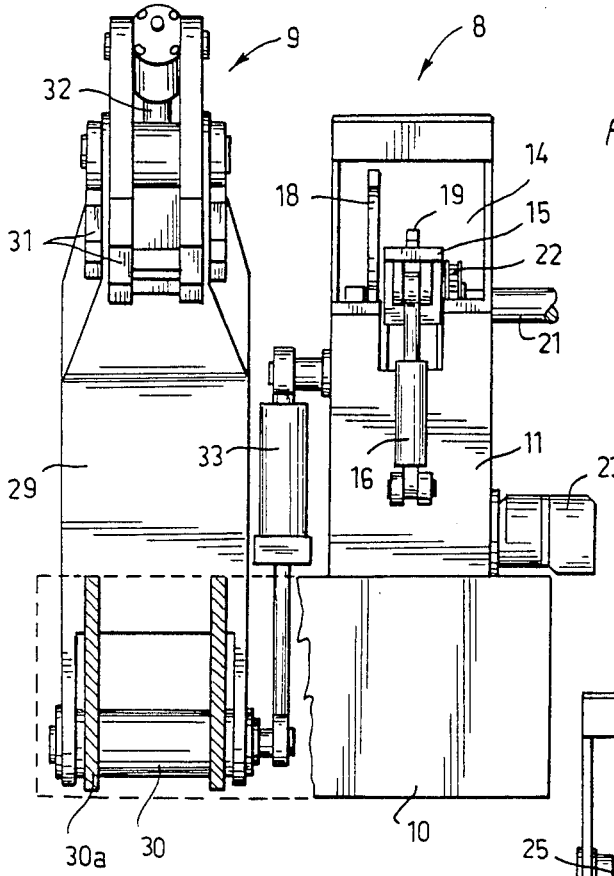
Figure 3:
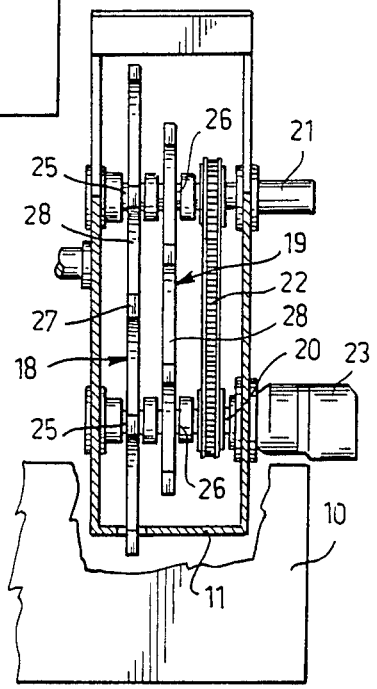
FIG. 3 is a view, similar to FIG. 2, partially in section, of the magazine.

The drilling apparatus shown in FIG. 1 of the drawings comprises a feed beam 1 and a drilling machine 2 displaceable along said beam, and a feed storage 3 for drill rods. Although the feed storage in principle may be made in one part, it is in this embodiment complemented with a second mirror-symmetrical half 3A. In the following, the construction and operation of one half only will be described, but it is obvious that both halves, in practice, are synchronized to operate simultaneously in the same manner. In FIG. 1 are moreover outlined power means 4 for a drilling machine carriage and a drill rod guide 5. Also a guide bar 6 and a rear support 7 for the drill rods are shown in the Figure.

The feed storage 3 comprises a magazine 8 and a transfer device 9.

The magazine comprises a frame 10 to which are fastened guides 11 which form between themselves a straight feed chute 12 having a width substantially corresponding to the diameter of the drill rods 13 to be stored, FIG. 4. The magazine frame is rigidly fastened adjacent the feed beam 1 so that, when the feed beam is positioned in a horizontal position, the feed chute is located vertically, as appears from FIG. 4. The magazine guides form at the upper end a delivery opening 14 which can be closed by a closing plate 15 which is supported on the guide facing the feed beam and connected to a pressure fluid cylinder 16 displacing the closing plate.

The magazine 8 further comprises a feed device 17, FIG. 5, which comprises two comb-shaped feed plates 18, 19 located in parallel with each other in vertical planes at a small distance from each other. On the frame are mounted two parallel crankshafts 20, 21 which are located in parallel at a distance from each other and are connected to each other by means of a chain transmission 22. The rotary axes of the crankshafts are preferably parallel with the axes of the drill rods in the magazine. The lower crankshaft is connected to a hydraulic motor 23 rotating said crankshaft. The upper crankshaft is through an intermediate shaft 24, FIG. 1, connected in driving engagement with the corresponding crankshaft of the other half 3A of the magazine.

The feed plates 18, 19 are mounted on pivot shafts 25 and 26, respectively, of each crankshaft located at an angle of 180° from each other, FIG. 5A, so that as the crankshafts rotate, the movements of the feed plates are oppositely directed with respect to each other. Each feed plate is provided with spaced-apart gripping cams 27 which form between them, for example, semicircular notches 28 having a diameter substantially corresponding to the diameter of the drill rods. The diameter of circle of rotation of the axes of the pivot shafts 25, 26 of the crankshafts is one half of the distance between the centres of the notches and greater than one half of the diameter of the drill rod 13.

The transfer device 9 comprises a transfer arm 29 which is at one end pivotably mounted on a pivot shaft 30 which is parallel with the drilling axis and supported by means of brackets 30*a* on the frame 10 of the magazine. At the opposite end the transfer arm is provided with gripping jaws 31 connected to a pressure fluid cylinder 32. The transfer arm is connected to an operating cylinder 33 by means of which the transfer arm is pivotable from the position shown in FIG. 4A, in which the gripping jaws are located at the upper end of the guides 11 at the delivery opening, to the position shown in FIG. 4C, in which the gripping jaws are located on the drilling axis of the drilling machine, i.e. on the drilling axis A of the feed beam. The gripping jaws are arranged to firmly grip the drill rod during the transfer step and to serve as a guide when an extension joint between two drill rods is engaged and disengaged.

Figure 4A:
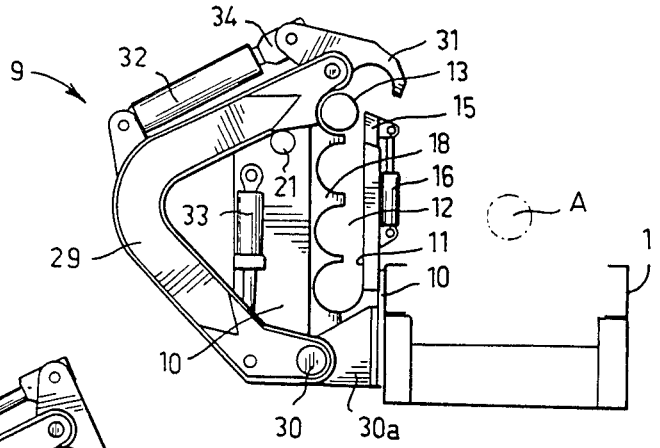
FIGS. 4A to 4D illustrate the feed storage in the direction of the feed beam in four different operating positions of the transfer device.

The transfer arm is V-shaped so that the upper leg of the transfer arm closes the upper end of the guides, as seen in the direction of the drilling axis, when the transfer arm is turned away from the magazine position shown in FIG. 4A.

The feed storage operates in the following manner:

For taking out a drill rod 13 from the magazine, the transfer arms 29 are located in the magazine position shown in FIG. 4A and the gripping jaws 31 are open. The crankshafts 20, 21 are rotated one revolution by means of the hydraulic motor 23. At this stage the feed plate 19 first displaces by means of its gripping cam 27 the drill rod upwards in the guides about one half of a revolution during which this feed plate gradually rotates out of engagement with the drill rod, while the other feed plate 18 gradually rotates into engagement with the drill rod and in turn displaces it upwards in the guide about one half of a revolution. In this way the drill rod is displaced a distance corresponding to one notch upwards in between the gripping jaws. The FIGS. 5A to 5G illustrate this transfer process.

Figure 4B:
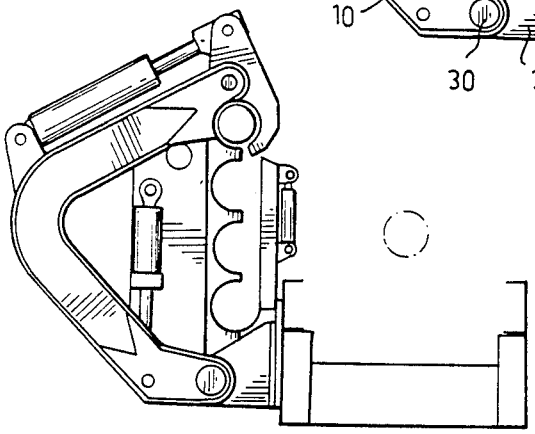
Figure 4C:
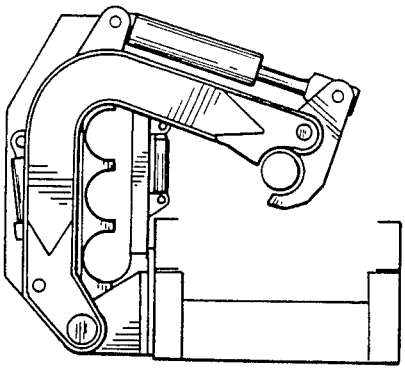
Figure 4D:
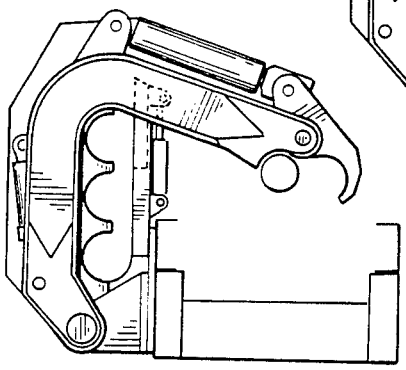

Hereafter the jaws are closed and the operating cylinder 16 opens the delivery opening 14 of the magazine, FIG. 4B. The operating cylinder turns the transfer arms 29 to the drilling axis position shown in FIG. 4C in which the drill rod is concentric with the drilling axis A of the drilling machine. The drilling machine is connected to the drill rod while utilizing the feeding movement and rotation of the drilling machine. The jaws are opened by means of the operating cylinder 32, FIG. 4D, whereby the drill rod can be passed through the drill guide 5 by means of the feeding movement of the drilling machine so that a drill bit can be fastened to the drill rod. The opening of the jaws of both transfer arms 29 is arranged so that they are opened simultaneously or the jaw facing the drill guide is opened later than the jaw facing the drilling machine. The shaft of the operating cylinder 32 of the jaws is provided with a flexible element 34, FIG. 4A, which facilitates the operation of the transfer arms for guidance when engaging and disengaging extension joints. Such a guidance is necessary when drilling oblique or horizontal holes. The flexible element may be of any known construction including a spring, a rubber piece, or similar. The flexible element can also be mounted elsewhere in the operating mechanism of the jaws. Hereafter the transfer arms are turned back to the magazine position for transferring the following drill rod.

The filling of the magazine is carried out according to FIGS. 4 in the sequence G-A in the following manner:

A drill rod to be inserted in the magazine is brought to the path of movement of the transfer arms, for example, by means of a winch or a separate lifting device. If, for safety reasons, the opening of the jaws is prevented during the pivoting movement, the gripping jaws are opened while the arms are located in the drilling axis position shown in FIG. 4D, and the drill rod is guided in between the jaws. The jaws are closed, FIG. 4C, whereafter the lifting device used for lifting the drill rod is disengaged. As the pressure increases in the operating cylinder 32 of the jaws, the operating cylinder 16 opens the delivery opening 14 of the magazine by displacing the closing plate 15 to the lower position. The operating cylinder 33 pivots the transfer arms into the magazine position shown in FIG. 4B, so that the drill rod is positioned into the opening 14 in the magazine. The operating cylinder 16 closes the delivery opening 14 earlier than the jaws are opened by displacing the closing plate 15 to the upper position, FIG. 4A.

The crankshafts 21 are rotated by means of the hydraulic motor 23 clockwise in FIG. 4 whereby the drill rod is displaced downwards in the guides, and a new drill rod can be brought to the opening in the magazine.

The drawings and the description relating thereto are only intended to illustrate the idea of the invention. In its details the feed storage according to the invention may vary within the scope of the claims.

What I claim is:

1. A feed storage for drill rods for a long-hole drilling apparatus, said feed storage comprising a magazine provided with fixed guides for storing the drill rods in the direction parallel to each other;

a delivery opening defined by said guides for transferring drill rods one at a time in and out of the guides;

a feed device provided with gripping means extending in between the drill rods positioned in the guides for feeding the drill rods in the guides towards and away from said delivery opening;

a transfer device having at least one transfer arm provided with gripping jaws and mounted pivotably on a pivot shaft, said pivot shaft fixed with respect to said magazine so that said gripping jaws are displacable transversally with respect to the axial direction of the drill rods between the delivery opening of the guides and drilling axis of the drilling apparatus;

said feed storage further comprising the guides of the magazine form between themselves at least one straight feed chute for guiding the drill rods having their axes in the same plane;

the feed device having at least one pair of feed plates carrying out simultaneous movements in opposite directions;

at least one pair of the feed plates of the feed device is comb-shaped, said feed plates of said pair mounted side by side on separate pivot shafts of two crankshafts located at a distance from each other and extending perpendicularly to the plane of the feed plates so that the feed plates are simultaneously displaceable in opposite directions with respect to each other along concentric circular arcs;

edges of the feed plates facing the guides provided with notches, said notches separated by the gripping cams for the drill rods, said gripping cams of each feed plate extend into the feed chute of the guides when the pivot shafts of said feed plates rotate towards the guides and locate outside the feed chute when said pivot shafts rotate away from the guides; and the transfer arm is pivoted so that the gripping jaws are displaced along a circular arc between the delivery opening of the guides and the drilling axis.

2. A feed storage according to claim 1, wherein the guides (11) form two feed chutes (12) spaced apart in the direction of said drilling axis and located in planes perpendicular to the pivot shaft (30) of the transfer arm (29).

3. A feed storage according to claim 1, wherein the diameter of the circle of rotation of the pivot shafts (25, 26) of the feed plates (18, 19) is greater than one half of the diameter of the drill rod (13).

4. A feed storage according to claim 1, wherein the transfer device (9) comprises two transfer arms (29) located at a distance from each other in the direction of said drilling axis (A).

5. A feed storage according to claim 1, wherein said delivery opening (14) is provided with a closing plate (15) by means of which said opening can be closed at least partly so as to prevent a drill rod (13) located in said chute (12) at the delivery opening (14) from being displaced out of said chute.

6. A feed storage according to claim 1, wherein the transfer arm closes the delivery opening of the guides when the transfer arm is pivoted to a position in which the gripping jaws are located on said drilling axis.

7. A feed storage according to claim 1, wherein the transfer arm has V-shaped configuration.

* * * * *